US008525761B2

(12) United States Patent
Sung et al.

(10) Patent No.: US 8,525,761 B2
(45) Date of Patent: Sep. 3, 2013

(54) DISPLAY DEVICE AND METHOD OF DRIVING THE SAME

(75) Inventors: Si-Duk Sung, Seoul (KR); Byung-Sik Koh, Gwangmyeong-si (KR); Young-Il Kim, Suwon-si (KR); Kyong-Tae Park, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 871 days.

(21) Appl. No.: 12/273,729

(22) Filed: Nov. 19, 2008

(65) Prior Publication Data

US 2009/0256785 A1 Oct. 15, 2009

(30) Foreign Application Priority Data

Apr. 14, 2008 (KR) ..... 10-2008-0034287

(51) Int. Cl.
*G09G 3/30* (2006.01)

(52) U.S. Cl.
USPC ..... 345/78

(58) Field of Classification Search
USPC ..... 345/78
See application file for complete search history.

(56) References Cited

U.S. PATENT DOCUMENTS

| | | | | |
|---|---|---|---|---|
| 2003/0231152 | A1* | 12/2003 | Shin | 345/83 |
| 2004/0066361 | A1* | 4/2004 | Ishii et al. | 345/87 |
| 2005/0140610 | A1* | 6/2005 | Smith et al. | 345/77 |
| 2008/0001861 | A1* | 1/2008 | Asano et al. | 345/77 |

FOREIGN PATENT DOCUMENTS

| | | |
|---|---|---|
| KR | 10-2005-0046143 | 5/2005 |
| KR | 10-2006-0005161 | 1/2006 |
| KR | 10-2007-0000122 | 1/2007 |

* cited by examiner

*Primary Examiner* — Quan-Zhen Wang
*Assistant Examiner* — Nelson D Runkle, III
(74) *Attorney, Agent, or Firm* — H.C. Park & Associates, PLC

(57) ABSTRACT

A display device and a method of driving the same are provided. The display device includes a scan driver that generates a plurality of scanning signals, a data driver that generates a data voltage, and a plurality of pixels that receive the data voltage according to the scanning signal and that display luminance corresponding to the data voltage. Each pixel receives its own data voltage and a data voltage of other pixels while displaying a black color when its own scanning signal is in a first state, and stops reception of the data voltage and displays luminance corresponding to its own data voltage when its own scanning signal is in a second state.

18 Claims, 12 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2008-0034287, filed on Apr. 14, 2008, which is hereby incorporated by reference for all purposes as if fully set forth herein.

BACKGROUND OF THE INVENTION

1. Field of the Invention

The present invention relates to a display device and a method of driving the same. More particularly, the present invention relates to an organic light emitting device and a method of driving the same.

2. Discussion of the Background

A hole-type flat panel display such as an organic light emitting device displays a fixed picture for a predetermined time period, (e.g., a frame), regardless of whether it is a still or motion picture. As an example, when a continuously moving object is displayed, the object moves from a particular position after being at the position for a certain time period of a frame, and is maintained at a new position of a frame for a certain time period before moving again, i.e., movement of the object is discretely displayed. Because the time period of a frame is a time period in which an afterimage is sustained, even if a picture is displayed in this way, movement of an object is continuously perceived.

However, when a continuously moving object is viewed on a screen, because a viewer's eye moves along with the object's movement, which conflicts with a discrete display of the display device, the viewer may see blur on a screen. For example, assume that the display device displays an object that stays at a position A in a first frame and at a position B in a second frame. In the first frame, the viewer's eye moves along an estimated movement path of the object from position A to position B. However, the object is not actually displayed at an intermediate position between position A and position B.

Therefore, because luminance that is recognized by a person for the first frame is a value, i.e., an average value of luminance of the object and luminance of a background that is obtained by integrating luminance of pixels at a path between position A and position B, an object is perceived to be blurred.

In the hole-type display device, because a degree to which the object is perceived to be blurred is proportional to a time period in which the display device sustains the display of the object, a so-called impulse driving method of displaying an image for only some time period and displaying a black color for the remaining time period within a frame has been suggested. In this method, because the time period in which an image is displayed decreases, luminance decreases, so a method of increasing luminance for a display time period or a method of displaying intermediate luminance using adjacent frames instead of a black color has been suggested. However, this method may increase power consumption and complicate driving.

Because a pixel of the organic light emitting device has an organic light emitting element and a thin film transistor (TFT) that drives the organic light emitting element, when the organic light emitting element and the TFT operate for a long time period, estimated luminance may not be displayed due to a change of the TFT's threshold voltage, and when characteristics of a semiconductor that is included in TFTs are not uniform within the display device, a luminance deviation between pixels may occur.

SUMMARY OF THE INVENTION

The present invention provides a display device and method of driving a display device.

Additional features of the invention will be set forth in the description which follows, and in part will be apparent from the description, or may be learned by practice of the invention.

The present invention discloses a display device including a scan driver that generates a plurality of scanning signals, a data driver that generates a data voltage, and a plurality of pixels that receive the data voltage according to the scanning signal and that display luminance corresponding to the data voltage. Each pixel receives its own data voltage and a data voltage of another pixel while displaying a black color when its own scanning signal is in a first state, and stops reception of the data voltage and displays luminance corresponding to its own data voltage when its own scanning signal is in a second state.

The present invention also discloses a display device including a scan driver that generates a plurality of scanning signals and a plurality of compensation signals, a data driver that generates a data voltage, and a plurality of pixels that receive the data voltage according to the scanning signals and that display luminance corresponding to the data voltage. Each pixel may include a light emitting element that emits light with an intensity according to a magnitude of a driving current; a capacitor that is connected between a first contact point and a second contact point; a driving transistor that has an input terminal connected to a first voltage and a control terminal connected to the second contact point, and that outputs the driving current; a first switching unit that connects the data voltage to the first contact point while the scanning signal is in a first state and that connects a second voltage to the first contact point while the scanning signal is in a second state; a second switching unit that switches connection between the second voltage and the second contact point according to the compensation signal; and a third switching unit that connects the second contact point to an output terminal of the driving transistor while the scanning signal is in the first state and that connects the light emitting element to the output terminal of the driving transistor while the scanning signal is in the second state. The data driver may change the data voltage in each one horizontal period, and the scanning signal may sustain the first state for a time period that is longer than one horizontal period.

The present invention also discloses a method of driving a display device, including outputting a data voltage that changes in each horizontal period, applying the data voltage to a pixel while stopping light emission of the pixel by applying a first scanning signal to the pixel for a time period that is longer than the one horizontal period, and allowing the pixel to emit light with luminance corresponding to the data voltage while stopping application of the data voltage to the pixel by applying a second scanning signal to the pixel, the first scanning signal and the second scanning signal having different levels from each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
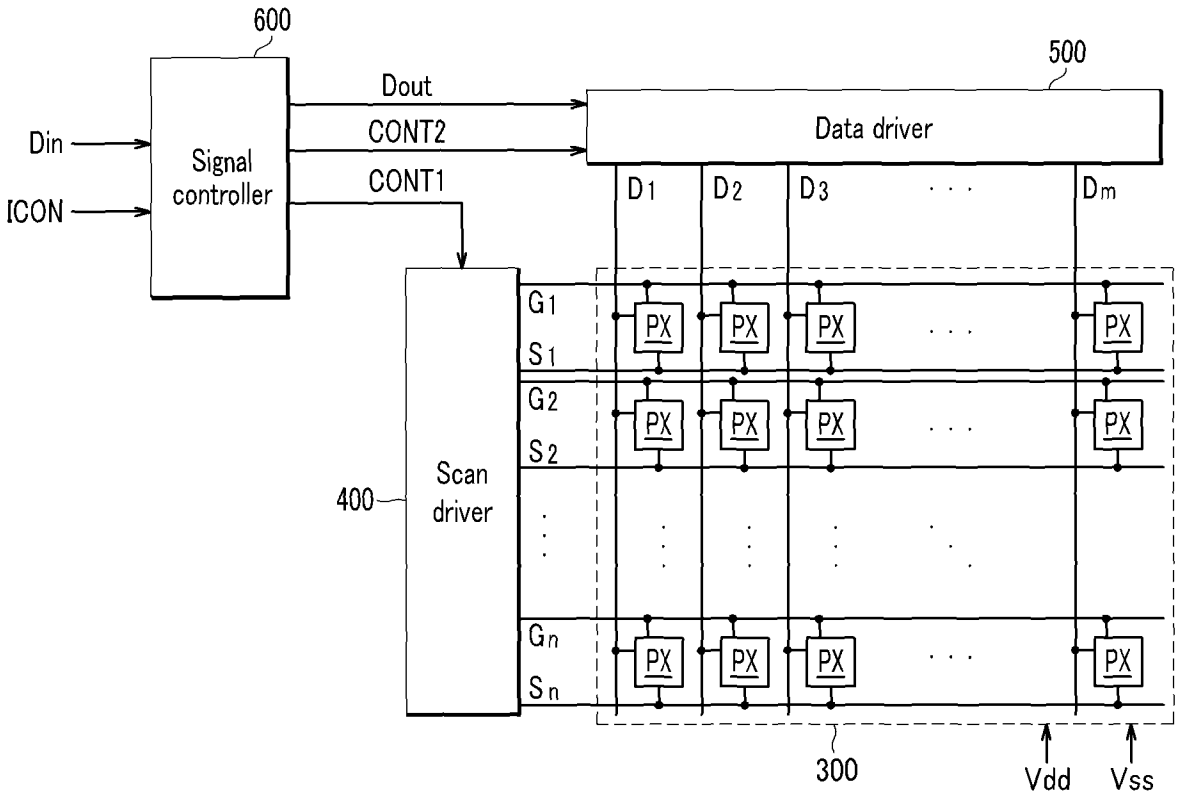
FIG. 1 is a block diagram of an organic light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

First, an organic light emitting device according to an exemplary embodiment of the present invention will be described with reference to FIG. 1 and FIG. 2.

Figure 2:
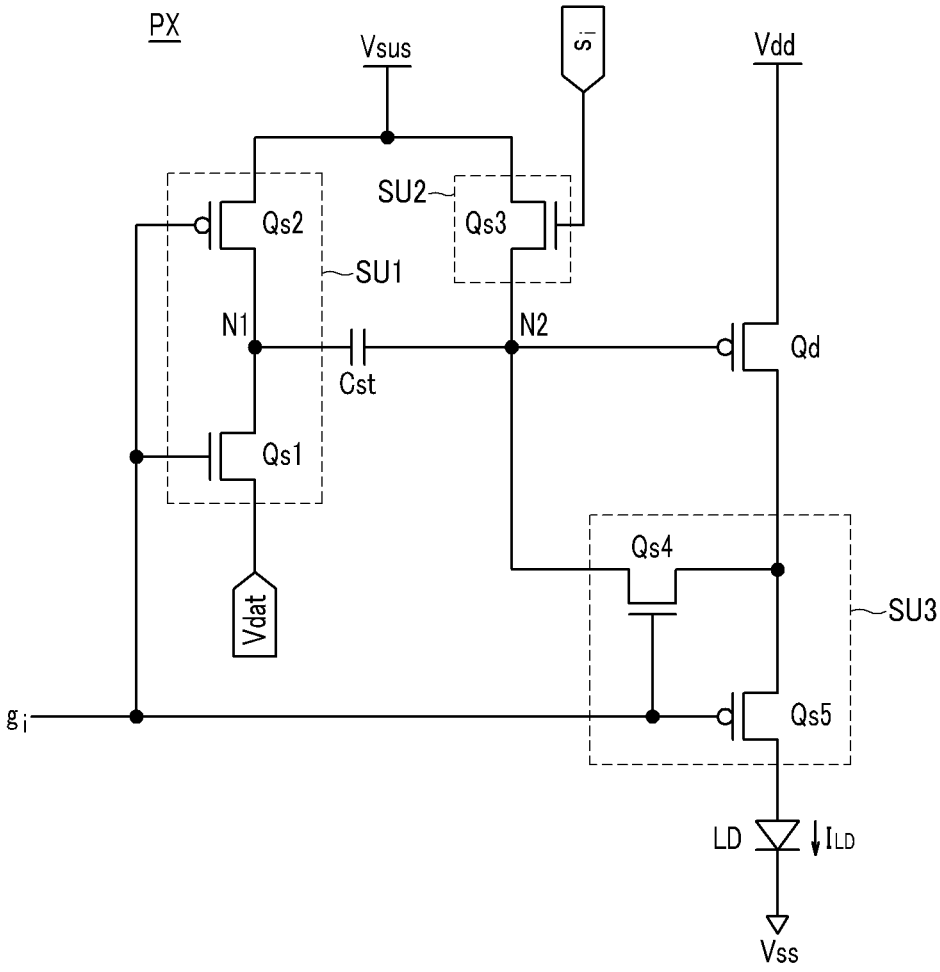
FIG. 2 is an equivalent circuit diagram of a pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of a pixel in an organic light emitting device according to an exemplary embodiment of the present invention.

Referring to FIG. 1, the organic light emitting device includes a display panel 300, a scan driver 400, a data driver 500, and a signal controller 600.

The display panel 300 includes a plurality of signal lines ($G_1$-$G_n$, $S_1$-$S_n$, and $D_1$-$D_m$), a plurality of voltage lines (not shown), and a plurality of pixels PX that are connected thereto and that are arranged in approximately a matrix form.

The signal lines ($G_1$-$G_n$, $S_1$-$S_n$, and $D_1$-$D_m$) include a plurality of scanning signal lines ($G_1$-$G_n$) that transmit a scanning signal, a plurality of compensation signal lines ($S_1$-$S_n$) that transmit a compensation signal, and a plurality of data lines ($D_1$-$D_m$) that transmit a data signal. The scanning signal lines ($G_1$-$G_n$) and the compensation signal lines ($S_1$-$S_n$) extend in approximately a row direction and are substantially parallel to each other, and the data lines ($D_1$-$D_m$) extend in approximately a column direction and are substantially parallel to each other.

The voltage line includes a driving voltage line (not shown) that transmits a driving voltage.

As shown in FIG. 2, each pixel PX includes an organic light emitting element LD, a driving transistor Qd, a capacitor Cst, and five switching transistors Qs1, Qs2, Qs3, Qs4, and Qs5.

The driving transistor Qd has an output terminal, an input terminal, and a control terminal. The control terminal of the driving transistor Qd is connected to the capacitor Cst at a contact point N2, its input terminal is connected to a driving voltage Vdd, and its output terminal is connected to the switching transistor Qs5.

A first electrode of the capacitor Cst is connected to the driving transistor Qd at the contact point N2, and a second electrode of the capacitor Cst is connected to the switching transistors Qs1 and Qs2 at a contact point N1.

The switching transistors Qs1-Qs5 may be formed in three switching units SU1, SU2, and SU3.

The switching unit SU1, which includes switching transistors Qs1 and Qs2, selects one of a data voltage Vdat and a sustain voltage Vsus in response to a scanning signal $g_i$ (i=1, 2, . . . , N) and connects the selected voltage to the contact point N1. The switching transistor Qs1 is connected between the contact point N1 and the data voltage Vdat, and the switching transistor Qs2 is connected between the contact point N1 and the sustain voltage Vsus.

The switching unit SU2, which includes switching transistor Qs3, switches connection between the sustain voltage Vsus and the contact point N2 in response to a compensation signal $s_i$. Switching transistor Qs3 is connected between the sustain voltage Vsus and the contact point N2.

The switching unit SU3, which includes switching transistors Qs4 and Qs5, selects one of the contact point N2 and the light emitting element LD in response to the scanning signal $g_i$ and connects the selected one to the output terminal of the driving transistor Qd. The switching transistor Qs4 is connected between the output terminal of the driving transistor Qd and the contact point N2, and the switching transistor Qs5 is connected between the output terminal of the driving transistor Qd and the organic light emitting element LD.

The switching transistors Qs1, Qs3, and Qs4 are n-channel field effect transistors, and the switching transistors Qs2 and Qs5 and the driving transistor Qd are p-channel field effect transistors. The field effect transistors may be thin film transistors (TFTs), for example, and they may include polysilicon or amorphous silicon. Channel types of the switching transistors Qs1-Q5 and the driving transistor Qd may change, and in this case, a driving signal waveform for driving the transistors may be inverted.

An anode and a cathode of the organic light emitting element LD are connected to the switching transistor Qs5 and the common voltage Vss, respectively. The organic light emitting element LD emits light with different intensities according to a magnitude of a current $I_{LD}$ that is supplied by the driving transistor Qd through the switching transistor Qs5, thereby displaying an image. A magnitude of the current $I_{LD}$ depends on a magnitude of a voltage between the control terminal and the input terminal of the driving transistor Qd.

Referring again to FIG. 1, the scan driver 400 is connected to the scanning signal lines ($G_1$-$G_n$) and the compensation signal lines ($S_1$-$S_n$) of the display panel 300, and it applies a scanning signal and a compensation signal, which both include a combination of a high voltage Von and a low voltage Voff, to the scanning signal lines ($G_1$-$G_n$) and the compensation signal lines ($S_1$-$S_n$), respectively.

The high voltage Von may allow the switching transistors Qs1, Qs3, and Qs4 to electrically connect and intercept the switching transistors Qs2 and Qs5, and the low voltage Voff may intercept the switching transistors Qs1, Qs3, and Qs4 and allow the switching transistors Qs2 and Qs5 to electrically connect. A sustain voltage Vsus is a low voltage, and it may intercept the switching transistors Qs1, Qs3, and Qs4 and allow the switching transistors Qs2 and Qs5 to electrically connect, like the low voltage Voff. The sustain voltage Vsus and the driving voltage Vdd may be applied through a driving voltage line.

The data driver 500 is connected to the data lines ($D_1$-$D_m$) of the display panel 300, and it applies a data voltage Vdat, which is used to display an image, to the data lines ($D_1$-$D_m$).

The signal controller 600 controls an operation of the scan driver 400, the data driver 500, a light emission driver, etc.

Each driving device 400, 500, and 600 may be directly mounted on the display panel 300 in at least one integrated circuit (IC) chip form, may be mounted on a flexible printed circuit film (not shown) to be attached to the display panel 300 in a tape carrier package (TCP) form, or may be mounted on a separate printed circuit board (PCB) (not shown). Alternatively, the driving devices 400, 500, and 600, together with the signal lines ($G_1$-$G_n$, $S_1$-$S_n$, and $D_1$-$D_m$) and the transistors (Qs1-Qs5, Qd) may be formed on the display panel 300. Further, the driving devices 400, 500, and 600 may be integrated in a single chip and in this case, at least one of them or at least one circuit element constituting them may be disposed at the outside of the single chip.

A display operation of the organic light emitting device is described in detail below with reference to FIG. 1, FIG. 2, FIG. 3, FIG. 4, FIG. 5, FIG. 6, and FIG. 7.

Figure 3:
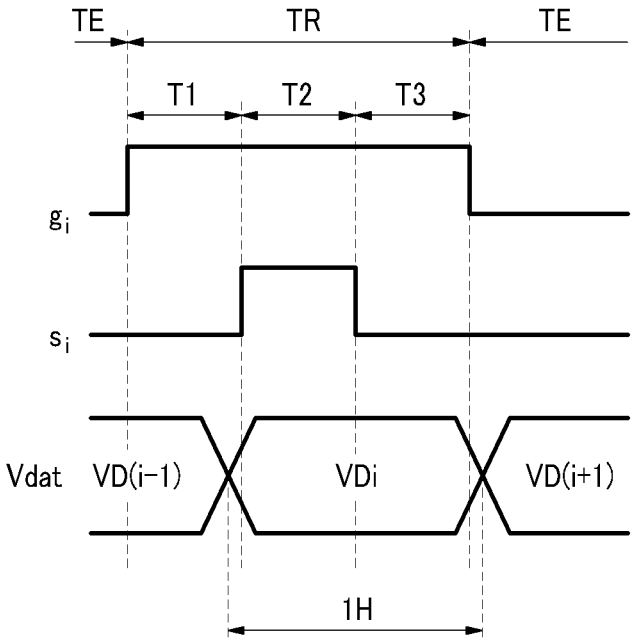
FIG. 3 shows an example of a driving signal waveform that may be applied to pixels of a row in an organic light emitting device according to an exemplary embodiment of the present invention.

FIG. 3 shows an example of a driving signal waveform that may be applied to pixels of a row in an organic light emitting device according to an exemplary embodiment of the present invention, and FIG. 4, FIG. 5, FIG. 6, and FIG. 7 are equivalent circuit diagrams of a pixel in each period that is shown in FIG. 3.

The signal controller 600 receives an input image signal Din and an input control signal ICON for controlling the display of the input image signal Din from an external graphics controller (not shown). The input image signal Din contains luminance information of each pixel PX, and the luminance has grays of a given quantity, for example, 1024 ($=2^{10}$), 256 ($=2^8$), or 64 ($=2^6$). The input control signal ICON includes, for example, a vertical synchronization signal, a horizontal synchronizing signal, a main clock signal, and a data enable signal.

The signal controller 600 processes the input image signal Din to correspond to an operating condition of the display panel 300 based on the input image signal Din and the input control signal ICON, and generates a scanning control signal CONT1 and a data control signal CONT2. The signal controller 600 then sends the scanning control signal CONT1 to the scanning driver 400, and sends the data control signal CONT2 and an output image signal Dout to the data driver 500.

The scanning control signal CONT1 may include a scanning start signal STV for instructing the scanning start of the high voltage Von to the scanning signal lines ($G_1$-$G_n$) and the compensation signal lines ($S_1$-$S_n$), at least one clock signal for controlling an output period of the high voltage Von, and an output enable signal OE for limiting a sustain time period of the high voltage Von.

The data control signal CONT2 includes a horizontal synchronization start signal for notifying the transmission start of a digital image signal Dout for one row of pixels PX, and a load signal and a data clock signal HCLK for applying a data signal, such as an analog data voltage, to the data lines ($D_1$-$D_m$).

The scan driver 400 sequentially changes a voltage of a scanning signal that is applied to the scanning signal lines ($G_1$-$G_n$) and a compensation signal that is applied to the compensation signal lines ($S_1$-$S_n$) to a high voltage Von, and changes the high voltage Von to a low voltage Voff according to the scan control signal CONT1 from the signal controller 600.

According to the data control signal CONT2 from the signal controller 600, the data driver 500 receives a digital output image signal Dout for each row of pixels PX, converts the digital output image signal Dout to an analog data voltage Vdat, and then applies the analog data voltage Vdat to the data lines ($D_1$-$D_m$). The data driver 500 outputs a data voltage Vdat for pixels PX of one row for one horizontal period 1H, as shown in FIG. 3.

A specific pixel row, for example an i-th row, is described below.

Referring to FIG. 3, the scan driver 400 changes a voltage of a scanning signal $g_i$ that is applied to the scanning signal line $G_i$ to a high voltage Von according to a scan control signal CONT1 from the signal controller 600. In this case, a compensation signal $s_i$ that is applied to the compensation signal line $S_i$ is in a low voltage Voff state, and a data voltage Vdat that is applied to the data lines ($D_1$-$D_m$) is a data voltage ($VD_{i-1}$) for pixels of a previous row and a data voltage VDi for a pixel of a current row. However, when a voltage of the scanning signal $g_i$ changes from a low voltage Voff to a high voltage Von, a data voltage Vdat that is applied to the data lines ($D_1$-$D_m$) may be a data voltage for pixels of a previous row.

Figure 4:
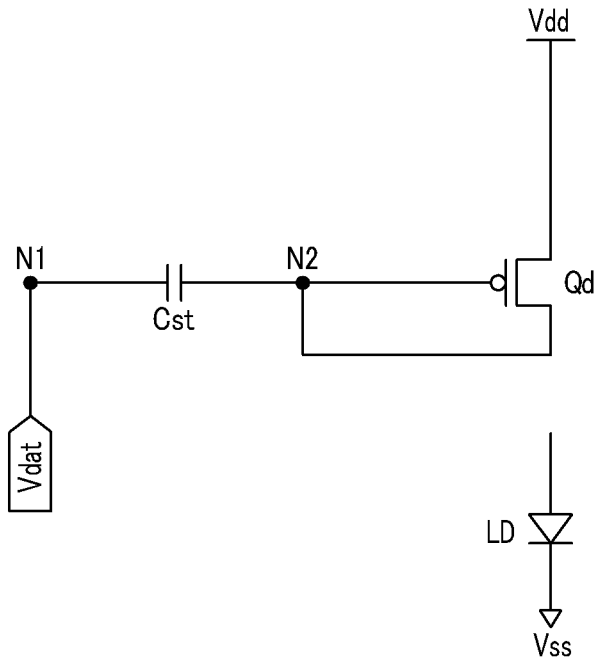
FIG. 4, FIG. 5, FIG. 6, and FIG. 7 are equivalent circuit diagrams of a pixel in each period that is shown in FIG. 3.

Accordingly, as shown in FIG. 4, the switching transistors Qs1 and Qs4 are electrically connected, the switching transistors Qs2 and Qs5 are intercepted, and the switching transistor Qs3 sustains an interception state.

If the switching transistor Qs5 is intercepted, the organic light emitting element LD does not emit light, and a period from this time point until a voltage of the scanning signal $g_i$ changes to a low voltage Voff and the switching transistor Qs5 is again electrically connected is a non-light emitting period TR.

If the switching transistor Qs3 is in an interception state and the switching transistor Qs4 is electrically connected, the driving transistor Qd that has been flowing a current to the organic light emitting element LD instead flows a current to the contact point N2 because its output terminal is connected to its control terminal. Thereafter, if a voltage of the contact point N2, (i.e., the difference between a voltage of a control terminal of the driving transistor Qd and a voltage of an input terminal thereof), becomes a threshold voltage Vth of the driving transistor Qd, the driving transistor Qd is in an interception state. In this case, because the switching transistor Qs1 is in an electrical connection state, after a data voltage ($VD_{i-1}$) of a previous pixel row is applied to the contact point N1, a data voltage ($VD_i$) of a current pixel row starts to be applied thereto.

In this way, in this period, because most of the data voltage ($VD_{i-1}$) of a previous pixel row is charged to the capacitor Cst, this period is called a precharging period T1.

Referring to FIG. 3, the scan driver 400 changes a voltage of a compensation signal $s_i$ that is applied to the compensation signal line $S_i$ to a high voltage Von, thereby starting a charging period T2.

Figure 5:
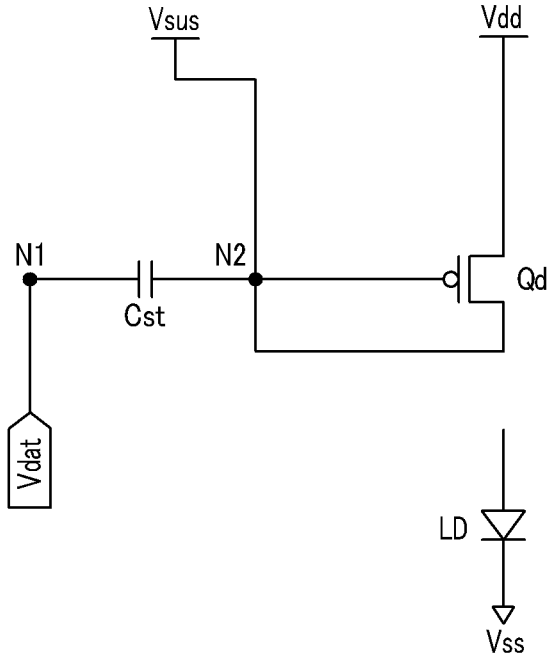

Accordingly, as shown in FIG. 5, the switching transistor Qs3 is electrically connected, the switching transistors Qs1 and Qs4 sustain an electrical connection state, and the switching transistors Qs2 and Qs5 sustain an interception state.

In this state, a data voltage VDi of a current pixel row is applied to the contact point N1, a sustain voltage Vsus is applied to the contact point N2, and a voltage difference between two contact points N1 and N2 is stored in the capacitor Cst. Therefore, the driving transistor Qd is electrically connected to flow a current, but because the switching transistor Qs5 is intercepted, the organic light emitting element LD remains off.

Referring to FIG. 3, as a voltage of the compensation signal $s_i$ changes to a low voltage Voff, the switching transistor Qs3 is in an interception state, thereby starting a compensation period T3. Because the scanning signal $g_i$ continues to sustain a high voltage Von in the compensation period T3, the switching transistors Qs1 and Qs4 sustain an electrical connection state, and the switching transistor Qs2 and Qs5 sustain an interception state.

Figure 6:
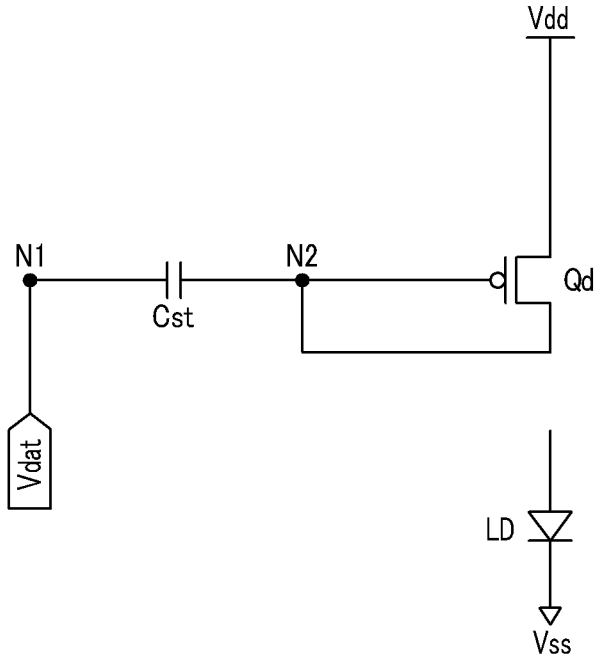

Accordingly, as shown in FIG. 6, the contact point N2 is separated from a sustain voltage Vsus. However, because the driving transistor Qd sustains an electrical connection state, charges that have been charged in the capacitor Cst are discharged through the driving transistor Qd. The discharge stops after being sustained until a voltage difference between a control terminal and an input terminal of the driving transistor Qd becomes a threshold voltage Vth of the driving transistor Qd.

Therefore, a voltage $V_{N2}$ of the contact point N2 is converged to the following voltage value.

$$V_{N2}=Vdd+Vth \quad \text{(Equation 1)}$$

In this case, because a voltage $V_{N1}$ of the contact point N1 sustains a data voltage $VD_i$ of a current pixel row, a voltage that is stored in the capacitor Cst is represented by Equation 2.

$$V_{N1}-V_{N2}=VDi-(Vdd+Vth) \quad \text{(Equation 2)}$$

Thereafter, as shown in FIG. 3, the scan driver 400 changes a voltage of a scanning signal $g_i$ to a low voltage Voff, thereby intercepting the switching transistors Qs1 and Qs4 and electrically connecting the switching transistor Qs2 and Qs5, thereby starting a light emitting period TE. Because the compensation signal $s_i$ continues to sustain a low voltage Voff state in the light emitting period TE, the switching transistor Qs3 also sustains an interception state.

Figure 7:
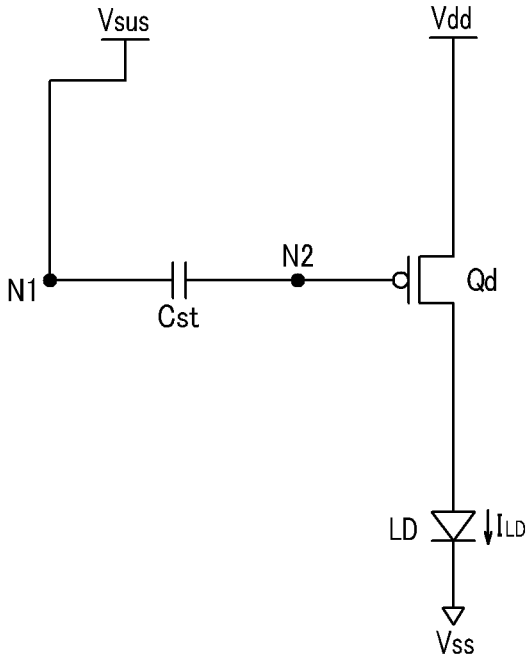

Thus, as shown in FIG. 7, the contact point N1 is separated from the data voltage Vdat and connected to the sustain voltage Vsus, and a control terminal of the driving transistor Qd is floated.

Therefore, a voltage $V_{N2}$ of the contact point N2 is represented by Equation 3.

$$V_{N2}=Vdd+Vth-VDi+Vsus \quad \text{(Equation 3)}$$

Due to electrical connection of the switching transistor Qs5, an output terminal of the driving transistor Qd is connected to the light emitting element LD, and the driving transistor Qd flows an output current $I_{LD}$ that is controlled by a voltage difference Vgs between its control terminal and input terminal.

$$\begin{aligned} I_{LD} &= \frac{1}{2}\times K\times(Vgs-Vth)^2 \\ &= \frac{1}{2}\times K\times(V_{N2}-Vdd-Vth)^2 \\ &= \frac{1}{2}\times K\times(Vdd+Vth-VDi+Vsus-Vdd-Vth)^2 \\ &= \frac{1}{2}\times K\times(VDi-Vsus)^2 \end{aligned} \quad \text{(Equation 4)}$$

Here, K is a constant according to characteristics of the driving transistor Qd. Specifically, K=μ·Ci·W/L, where μ is electric field effect mobility, Ci is capacity of a gate insulating layer, W is a channel width of the driving transistor Qd, and L is a channel length of the driving transistor Qd.

According to Equation 4, an output current $I_{LD}$ of the light emitting period TE is determined by only the constant K, a data voltage Vdat (i.e., VDi), and a fixed sustain voltage Vsus. Therefore, the output current $I_{LD}$ is not influenced by a threshold voltage Vth of the driving transistor Qd.

The output current $I_{LD}$ is supplied to the organic light emitting element LD, and the organic light emitting element LD emits light with different intensities according to a magnitude of the output current $I_{LD}$, thereby displaying an image.

Therefore, even if a deviation exists in a threshold voltage Vth between the driving transistors Qd or a magnitude of a threshold voltage Vth of each driving transistor Qd sequentially changes, a uniform image can be displayed.

By advancing a time point for forming a voltage of the scanning signal $g_i$ at a high voltage Von by a necessary time period, light emission of the light emitting element LD is prevented for a desired time period, whereby a time period in which the pixel PX is in a black color state can be extended.

A scan driver for forming such a scanning signal and a compensation signal is described in detail below with reference to FIG. 8, FIG. 9, FIG. 10, FIG. 11, and FIG. 12.

Figure 8:
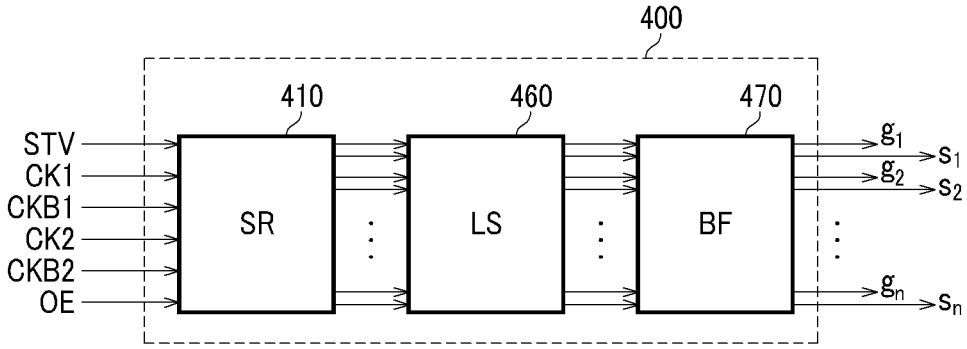
FIG. 8 is a block diagram showing a configuration of a scan driver according to an exemplary embodiment of the present invention.
Figure 9:
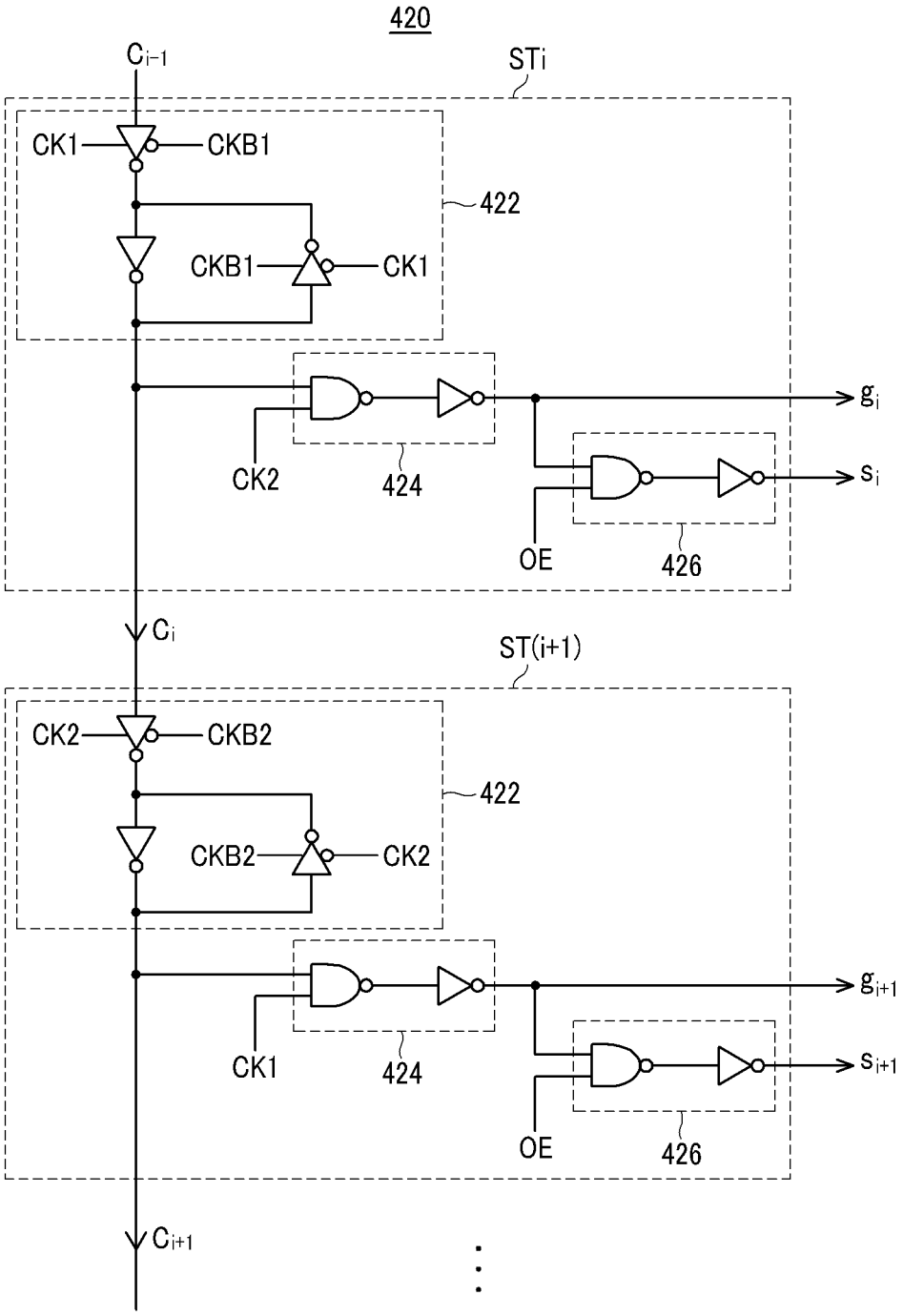
FIG. 9 shows an example of a circuit diagram of a shift register in the scan driver that is shown in FIG. 8.
Figure 10:
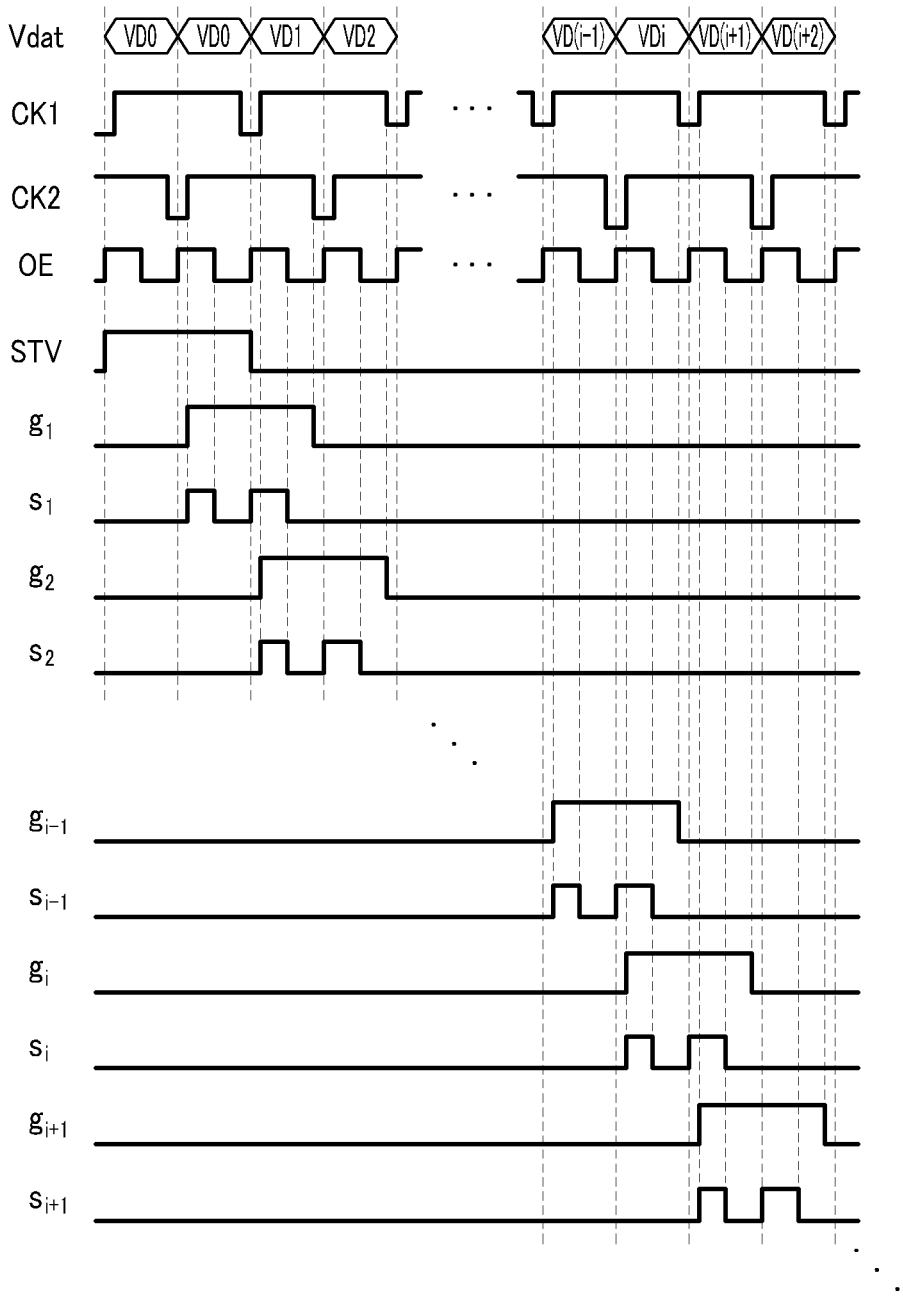
FIG. 10 is a signal waveform diagram of an organic light emitting device having the scan driver of FIG. 9.
Figure 11:
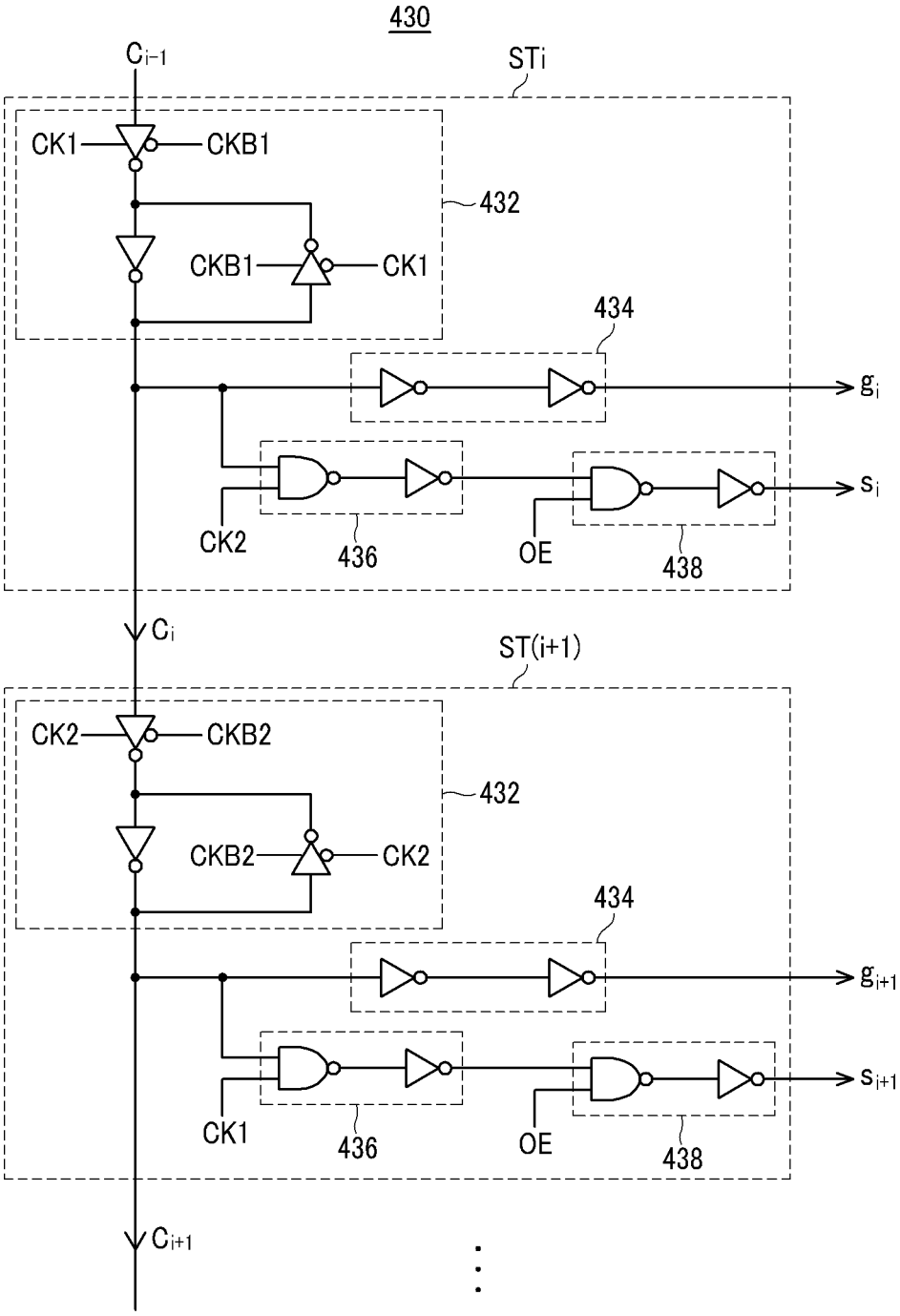
FIG. 11 shows another example of a circuit diagram of a shift register in the scan driver that is shown in FIG. 8.
Figure 12:
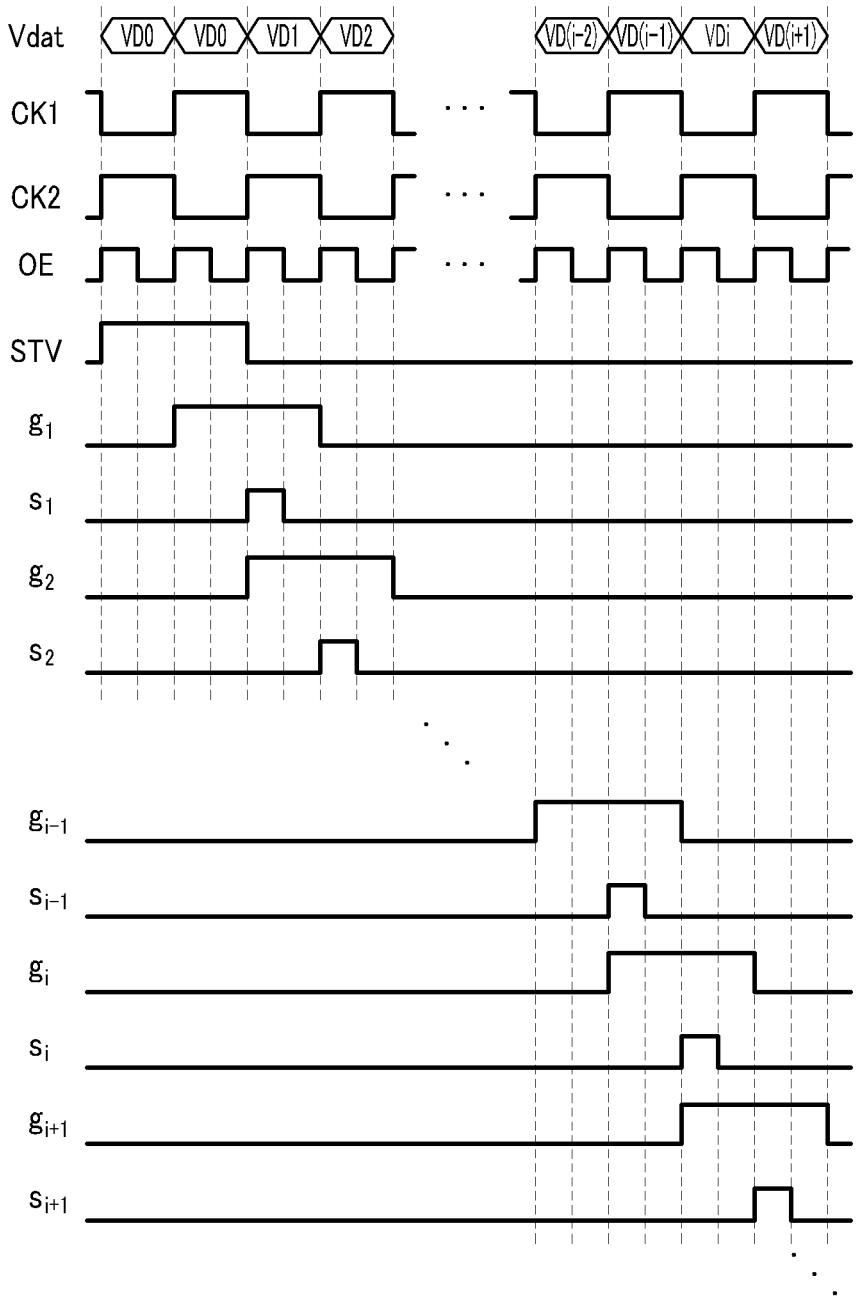
FIG. 12 is a signal waveform diagram of an organic light emitting device having the scan driver of FIG. 11.

FIG. 8 is a block diagram showing a configuration of a scan driver according to an exemplary embodiment of the present invention, FIG. 9 shows an example of a circuit diagram of a shift register in the scan driver of FIG. 8, FIG. 10 is a signal waveform diagram of an organic light emitting device having the scan driver of FIG. 9, FIG. 11 shows another example of a circuit diagram of a shift register in the scan driver of FIG. 8, and FIG. 12 is a signal waveform diagram of an organic light emitting device having the scan driver of FIG. 11.

Referring to FIG. 8, a scan driver 400 according to an exemplary embodiment of the present invention includes a shift register 410, a level shifter 460, and a buffer 470 that are sequentially connected.

The shift register 410 includes a plurality of stages that are sequentially connected, and a scanning start signal STV, a plurality of clock signals (CK1, CKB1, CK2, and CKB2), and an output enable signal OE are input thereto.

Each stage generates and outputs scanning signals ($g_1$-$g_n$) and compensation signals ($s_1$-$s_n$).

The level shifter 460 adjusts and outputs a voltage value of scanning signals ($g_1$-$g_n$) and compensation signals ($s_1$-$s_n$) that are output from the shift register 410, and the buffer 470 performs a function of sustaining the scanning signals ($g_1$-$g_n$) and the compensation signals ($s_1$-$s_n$) that are output from the level shifter 460.

In the shift register 420 that is shown in FIG. 9, each stage ($ST_i$, $ST_{i+1}$) includes a latch 422, a waveform cutter 424, and an output definer 426.

The latch 422 delays carry output signals ($C_{i-1}$, $C_i$) (a scanning start signal STV in a first stage) of a previous stage and outputs the carry output signals ($C_{i-1}$, $C_i$) as its own carry output signals ($C_i$, $C_{i+1}$). The latch 422 includes two clocked inverters and one regular inverter. One clocked inverter inverts carry output signals ($C_{i-1}$, $C_i$) of a previous stage and sends inverted the carry output signals ($C_{i-1}$, $C_i$) to a regular inverter according to the first/second clock signal (CK1/CK2), and the regular inverter inverts and outputs an input signal. Another clocked inverter inverts the output of the regular inverter and sends the inverted output to the regular inverter according to first/second inversion clock signals (CKB1/CKB2).

As shown in FIG. 10, a period of the first clock signal CK1 and the second clock signal CK2 is two times a horizontal period 1H, and a duty ratio thereof is greater than 50%. The first clock signal CK1 and the second clock signal CK2 have a phase difference of about 180°, and the first/second inversion clock signal (CKB1/CKB2) is an inversion signal of the first/second clock signal (CK1/CK2), respectively. The scanning start signal STV and the carry output signals ($C_{i-1}$, $C_i$, and $C_{i+1}$) sustain a high voltage Von state for two horizontal periods 2H, and each of the carry output signals ($C_i$, $C_{i+1}$) is delayed by about one horizontal period 1H from front end carry output signals ($C_{i-1}$, $C_i$).

The waveform cutter 424 cuts and outputs an output signal of the latch 422 according to the second/first clock signal CK2/CK1. The waveform cutter 424 includes a NAND gate and an inverter. Thus, it is identical to an AND gate from a logical view. The NAND gate uses the output of the latch 422 and the second/first clock signal CK2/CK1 as two inputs, and the output thereof is input to the inverter. The output signal of the waveform cutter 424 becomes scanning signals ($g_1$-$g_n$), and is in a high voltage state for approximately a high voltage period of the second/first clock signal CK2/CK1.

The output definer 426 cuts and outputs the output signal of the waveform cutter 424 according to the output enable signal OE. The output definer 426 also includes a NAND gate and an inverter. Thus, it is identical to an AND gate from a logical view. The NAND gate uses the output of the waveform cutter 424 and the output enable signal OE as two inputs, and the output thereof is input to the inverter. A period of the output enable signal OE is identical to one horizontal period 1H, and it may have various duty ratios, including about 50% as shown in FIG. 10. The output of the output definer 426 becomes compensation signals ($s_1$-$s_n$), which become a high voltage two times while the scanning signals ($g_1$-$g_n$) are at a high voltage.

A period in which the scanning signals ($g_1$-$g_n$) are at a high voltage is longer than one horizontal period 1H, and a data voltage ($VD_0$-$VD_{n-1}$) ($VD_0$ is a null data voltage) of a previous pixel row is applied to each pixel PX for a front half period, and data voltages ($VD_1$-$VD_n$) of the corresponding pixel are applied for a rear half period. The compensation signals ($s_1$-$s_n$) become a high voltage one time for a front half period in a period in which the scanning signals ($g_1$-$g_n$) are at a high voltage, and become a high voltage one more time for a rear half period. Thereby, the driving transistor Qd operates according to the data voltages ($VD_0$-$VD_{n-1}$) of a previous pixel row, but because the organic light emitting element LD does not operate, each pixel PX does not display the data voltages ($VD_0$-$VD_{n-1}$) of a previous pixel row with luminance.

Consequently, because each pixel PX displays a black color for a time period that is longer than one horizontal period 1H, an impulse effect may be improved.

In the shift register 430 of FIG. 11, each stage ($ST_i$, $ST_{i+1}$) includes a latch 432, a voltage sustainer 434, a waveform cutter 436, and an output definer 438.

The latch 432, which includes two clocked inverters and one regular inverter, delays carry output signals ($C_{i-1}$, $C_i$) (a scanning start signal STV in a first stage) of a previous stage and outputs the carry output signals ($C_{i-1}$, $C_i$) as its own carry output signals ($C_i$, $C_{i+1}$), similar to the latch 422 of FIG. 9. One clocked inverter inverts carry output signals ($C_{i-1}$, $C_i$) of a previous stage and sends the inverted carry output signals ($C_{i-1}$, $C_i$) to a regular inverter according to the first/second clock signal CK1/CK2, and the regular inverter inverts and outputs an input signal. Another clocked inverter inverts the output of the regular inverter and sends the inverted output to the regular inverter according to the first/second inversion clock signal CKB1/CKB2.

As shown in FIG. 12, a period of the first clock signal CK1 and the second clock signal CK2 is two times a horizontal period 1H, and a duty ratio thereof is 50% or below. The first clock signal CK1 and the second clock signal CK2 have a phase difference of about 180°, and the first/second inversion clock signal CKB1/CKB2 is an inversion signal of the first/second clock signal CK1/CK2, respectively. The scanning start signal STV and the carry output signals ($C_{i-1}$, $C_i$, and $C_{i+1}$) sustain a high voltage Von state for two horizontal periods 2H, and each of the carry output signals ($C_i$, $C_{i+1}$) is delayed by about one horizontal period 1H from front end carry output signals ($C_{i-1}$, $C_i$).

The voltage sustainer 434 includes two inverters, and an output thereof becomes scanning signals ($g_i$, $g_{i+1}$). The scanning signals ($g_1$-$g_n$) sustain a high voltage Von state for two horizontal periods 2H, and each scanning signal ($g_1$-$g_n$) is delayed by about one horizontal period 1H from a scanning start signal STV or front end scanning signals ($g_1$-$g_{n-1}$). The voltage sustainer 434 may be omitted, and the carry output signals ($C_{i-1}$, $C_i$, and $C_{i+1}$) may be directly used as scanning signals ($g_1$-$g_n$).

The waveform cutter 436 cuts and outputs an output signal of the latch 432 according to the second/first clock signal CK2/CK1. The waveform cutter 436 includes a NAND gate and an inverter. Thus, it is identical to an AND gate from a logical view. The NAND gate uses an output of the latch 432 and the second/first clock signal CK2/CK1 as two inputs, and an output thereof is input to the inverter.

The output definer 438 cuts and outputs an output signal of the waveform cutter 436 according to an output enable signal OE. The output definer 438 also includes a NAND gate and an inverter. Thus, it is identical to an AND gate from a logical view. The NAND gate uses an output of the waveform cutter 436 and an output enable signal OE as two inputs, and the output thereof is input to the inverter. A period of the output enable signal OE is identical to one horizontal period 1H, and it may have various duty ratios, including about 50% as shown in FIG. 12. The output of the output definer 438 becomes compensation signals ($s_i$, $s_{i+1}$), which become a high voltage only one time while the scanning signals ($g_1$-$g_n$) are a high voltage, unlike the case of FIG. 9 and FIG. 10.

A period in which the scanning signals ($g_1$-$g_n$) are at a high voltage is longer than one horizontal period 1H, and data voltages ($VD_0$-$VD_{n-1}$) ($VD_0$ is a null data voltage) of a previous pixel row are applied to each pixel PX for a front half period and data voltages ($VD_1$-$VD_n$) of the corresponding pixel are applied for a rear half period. A voltage of the compensation signals ($S_1$-$S_n$) becomes a high voltage one time for a rear half period in a period in which the scanning signals ($g_1$-$g_n$) are at a high voltage.

Consequently, because each pixel PX displays a black color for a time period that is longer than one horizontal period 1H, an impulse effect may be improved. Particularly, in the present exemplary embodiment, a time period in which the scanning signals ($g_1$-$g_n$) are at a high voltage can be lengthened by a desired time period by extending a high voltage period of a scanning start signal STV, and thus a black color display time period can be freely adjusted, as compared with the exemplary embodiment that is described in FIG. 9 and FIG. 10.

The scan driver and the driving method thereof shown in FIG. 9, FIG. 10, FIG. 11, and FIG. 12 can be applied to other pixels besides the pixel PX shown in FIG. 2, and they can be applied to other display devices besides an organic light emitting device. For example, the scan driver and the method of driving the same can be applied when a scanning signal is in a high voltage state, each pixel receives a data voltage while displaying a black color, and when a scanning signal is in a low voltage state, each pixel stops reception of a data voltage and displays luminance corresponding to its own data voltage. In FIG. 2, even in a case where switching transistors Qs2, Qs3, and Qs4, which compensate a threshold voltage of the driving transistor Qd, are omitted, the scan drivers and the methods of driving the same that are shown in FIG. 9, FIG. 10, FIG. 11, and FIG. 12 can be applied. In this case, portions 426, 436, and 438 that are related to compensation signals may be omitted.

By adjusting a high voltage period length of the scanning signal, impulse driving can be realized.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a scan driver configured to generate a plurality of scanning signals;

a data driver configured to generate a data voltage; and a plurality of pixels configured to:

receive the data voltage according to the scanning signals, and display luminance corresponding to the data voltage, wherein each pixel is configured to:

receive its own data voltage and a data voltage of another pixel, while displaying a black color, while its own scanning signal is in a first state, and stop reception of the data voltage and display luminance corresponding to its own data voltage while its own scanning signal is in a second state, wherein:

the scan driver comprises a shift register comprising a plurality of first stages and a plurality of second stages, the first stages and the second stages being alternately connected, each first stage comprises:

a first latch configured to delay a carry output signal of a previous second stage according to a first clock signal and output the carry output signal as its own carry output signal, and a first waveform cutter configured to cut an output signal of the first latch according to a second clock signal and output the output signal as a scanning signal, and each second stage comprises:

a second latch configured to delay a carry output signal of a previous first stage according to the second clock signal and output the carry output signal as its own carry output signal, and a second waveform cutter configured to cut an output signal of the second latch according to the first clock signal and output the output signal as the scanning signal, the first clock signal and the second clock signal have a phase difference of 180°, each of the first clock signal and the second clock signal has a duty ratio greater than 50%, and the scanning signal of the first stage sustains a first state while the second clock signal is at a high level.

2. The display device of claim 1, wherein:

the scan driver is configured to generate a plurality of compensation signals;

each pixel comprises:

a driving transistor configured to generate a driving current according to the pixel's own data voltage, and a light emitting element configured to emit light with different intensities according to a magnitude of the driving current; and each pixel is configured to compensate a threshold voltage of the driving transistor according to the pixel's own compensation signal while the pixel's own scanning signal is in the first state.

3. The display device of claim 2, wherein:

each first stage further comprises a first output definer configured to cut an output signal of the first waveform cutter according to an output enable signal and output the output signal as a compensation signal; and each second stage further comprises a second output definer configured to cut an output signal of the second waveform cutter according to the output enable signal and output the output signal as a compensation signal.

4. The display device of claim 3, wherein a period of the output enable signal is a half of a period of the first clock signal and the second clock signal.

5. The display device of claim 1, wherein each pixel is configured to receive its own data voltage and the data voltage of another pixel at a terminal of a corresponding voltage storage device.

6. A display device, comprising:

a scan driver configured to generate a plurality of scanning signals;

a data driver configured to generate a data voltage; and a plurality of pixels configured to:

receive the data voltage according to the scanning signals, and display luminance corresponding to the data voltage, wherein each pixel is configured to:

receive its own data voltage and a data voltage of another pixel, while displaying a black color, while its own scanning signal is in a first state, and stop reception of the data voltage and display luminance corresponding to its own data voltage while its own scanning signal is in a second state, wherein:

the scan driver comprises a shift register comprising a plurality of first stages and a plurality of second stages, the first stages and the second stages being alternately connected, each first stage comprises a first latch configured to delay a carry output signal of a previous second stage according to a first clock signal and output the carry output signal as its own carry output signal and a scanning signal, each second stage comprises a second latch configured to delay a carry output signal of a previous first stage according to a second clock signal and output the carry output signal as its own carry output signal and the scanning signal, and the first clock signal and the second clock signal have a phase difference of 180°, wherein each of the first clock signal and the second clock signal has a duty ratio of 50% or less, wherein the scanning signal of the first stage sustains a first state for a time period that is longer than a half period of the second clock signal, and wherein:

the scan driver is configured to generate a plurality of compensation signals;

each pixel comprises:

a driving transistor configured to generate a driving current according to the pixel's own data voltage, and a light emitting element configured to emit light with different intensities according to a magnitude of the driving current; and each pixel is configured to compensate a threshold voltage of the driving transistor according to the pixel's own compensation signal while the pixel's own scanning signal is in a first state.

7. The display device of claim 6, wherein:

each first stage comprises:

a first waveform cutter configured to cut and output an output signal of the first latch according to the second clock signal, and a first output definer configured to cut an output signal of the first waveform cutter according to an output enable signal and output the output signal as a compensation signal; and each second stage comprises:

a second waveform cutter configured to cut and output an output signal of the second latch according to the first clock signal, and a second output definer configured to cut an output signal of the second waveform cutter according to the output enable signal and output the output signal as a compensation signal.

8. The display device of claim 7, wherein a period of the output enable signal is a half of a period of the first clock signal and the second clock signal.

9. A display device, comprising:

a scan driver configured to generate a plurality of scanning signals and a plurality of compensation signals;

a data driver configured to generate a data voltage; and a plurality of pixels configured to receive the data voltage according to the plurality of scanning signals and display luminance corresponding to the data voltage, wherein each pixel comprises:

a light emitting element configured to emit light with an intensity according to a magnitude of a driving current, a capacitor connected between a first contact point and a second contact point, a driving transistor comprising an input terminal connected to a first voltage and a control terminal connected to the second contact point, the driving transistor configured to output the driving current, a first switching unit configured to connect the data voltage to the first contact point while the scanning signal is in a first state and connect a second voltage to the first contact point while the scanning signal is in a second state, a second switching unit configured to switch connection between the second voltage and the second contact point according to the compensation signal, and a third switching unit configured to connect the second contact point to an output terminal of the driving transistor while the scanning signal is in the first state and connect the light emitting element to the output terminal of the driving transistor while the scanning signal is in the second state, wherein the data driver is configured to change the data voltage in each one horizontal period, and wherein the scanning signal sustains the first state for a time period that is longer than one horizontal period.

10. The display device of claim 9, wherein:

the scan driver comprises a shift register comprising a plurality of first stages and a plurality of second stages, the first stages and the second stages being alternately connected;

each first stage comprises:

a first latch configured to delay a carry output signal of a previous second stage according to a first clock signal and output the carry output signal as its own carry output signal, a first waveform cutter configured to cut an output signal of the first latch according to a second clock signal and output the output signal as the scanning signal, and a first output definer configured to cut an output signal of the first waveform cutter according to an output enable signal and output the output signal as the compensation signal;

each second stage comprises:

a second latch configured to delay a carry output signal of a previous first stage according to the second clock signal and output the carry output signal as its own carry output signal, a second waveform cutter configured to cut an output signal of the second latch according to the first clock signal and output the output signal as the scanning signal, and a second output definer configured to cut an output signal of the second waveform cutter according to the output enable signal and output the output signal as the compensation signal;

a period of each of the first clock signal and the second clock signal is two times one horizontal period; and the first clock signal and the second clock signal have a phase difference of 180°.

11. The display device of claim 10, wherein each of the first clock signal and the second clock signal has a duty ratio greater than 50%, and the scanning signal of the first stage sustains a first state while the second clock signal is at a high level.

12. The display device of claim 11, wherein a period of the output enable signal is a half of a period of the first clock signal and the second clock signal.

13. The display device of claim 9, wherein:

the scan driver comprises a shift register including a plurality of first stages and a plurality of second stages, the first stages and the second stages being alternately connected;

each first stage comprises:

a first latch configured to delay a carry output signal of a previous second stage according to a first clock signal and output the carry output signal as its own carry output signal and the scanning signal, a first waveform cutter configured to cut and output an output signal of the first latch according to a second clock signal, and a first output definer configured to cut an output signal of the first waveform cutter according to an output enable signal and output the output signal as the compensation signal;

each second stage comprising:

a second latch configured to delay a carry output signal of a previous first stage according to the second clock signal and output the carry output signal as its own carry output signal and the scanning signal, a second waveform cutter configured to cut and output an output signal of the second latch according to the first clock signal, and a second output definer configured to cut an output signal of the second waveform cutter according to the output enable signal and output the output signal as the compensation signal;

a period of each of the first clock signal and the second clock signal is two times one horizontal period; and the first clock signal and the second clock signal have a phase difference of 180°.

14. The display device of claim 13, wherein each of the first clock signal and the second clock signal has a duty ratio of 50% or less.

15. The display device of claim 14, wherein a period of the output enable signal is a half of a period of the first clock signal and the second clock signal.

16. The display device of claim 9, wherein the second switching unit is configured to connect the second contact point to the second voltage and then release the connection while the scanning signal is in the first state.

17. The display device of claim 16, wherein the capacitor configured to store a threshold voltage of the driving transistor while the second contact point is connected to the second voltage.

18. A method of driving a display device, comprising:

outputting a data voltage that changes in each one horizontal period;

applying the data voltage to a pixel while stopping light emission of the pixel by applying an on voltage of a scanning signal to the pixel for a period that is longer than the one horizontal period;

applying an on voltage of a compensation signal to the pixel while the scanning signal is at the on voltage;

compensating a threshold voltage of a driving transistor in the pixel by applying an off voltage of the compensation signal to the pixel while the scanning signal is at the on voltage; and allowing the pixel to emit light with luminance corresponding to the data voltage while stopping application of the data voltage to the pixel by applying an off voltage of the scanning signal to the pixel.

* * * * *

UNITED STATES PATENT AND TRADEMARK OFFICE

CERTIFICATE OF CORRECTION

PATENT NO. : 8,525,761 B2
APPLICATION NO. : 12/273729
DATED : September 3, 2013
INVENTOR(S) : Sung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 925 days.

Signed and Sealed this
Tenth Day of March, 2015

Michelle K. Lee

Michelle K. Lee
*Deputy Director of the United States Patent and Trademark Office*